US008242989B2

(12) United States Patent
Kwon

(10) Patent No.: US 8,242,989 B2
(45) Date of Patent: Aug. 14, 2012

(54) ORGANIC LIGHT EMITTING DISPLAY AND DRIVING METHOD THEREOF

(75) Inventor: Oh-Kyong Kwon, Seoul (KR)

(73) Assignees: Samsung Mobile Display Co., Ltd., Yongin (KR); IUCF-HYU (Industry University Cooperation Foundation Hanyang University), Seoul (KR)

( * ) Notice: Subject to any disclaimer, the term of this patent is extended or adjusted under 35 U.S.C. 154(b) by 676 days.

(21) Appl. No.: 12/354,214

(22) Filed: Jan. 15, 2009

(65) Prior Publication Data

US 2009/0184903 A1 Jul. 23, 2009

(30) Foreign Application Priority Data

Jan. 18, 2008 (KR) ..... 10-2008-0005615

(51) Int. Cl.
*G09G 3/30* (2006.01)

(52) U.S. Cl. ..... 345/80; 345/94; 345/63; 345/690

(58) Field of Classification Search ..... None
See application file for complete search history.

(56) References Cited

U.S. PATENT DOCUMENTS

| | | | | |
|---|---|---|---|---|
| 6,518,962 | B2 | 2/2003 | Kimura et al. | |
| 7,113,156 | B2 | 9/2006 | Hashimoto | |
| 7,456,812 | B2 | 11/2008 | Smith et al. | |
| 7,518,577 | B2 | 4/2009 | Akimoto et al. | |
| 7,667,674 | B2 * | 2/2010 | Sato et al. | 345/76 |
| 7,675,492 | B2 * | 3/2010 | Park et al. | 345/77 |
| 7,760,171 | B2 | 7/2010 | Kwon | |
| 2005/0017934 | A1 | 1/2005 | Chung et al. | |
| 2005/0179625 | A1 | 8/2005 | Choi et al. | |
| 2006/0139264 | A1 | 6/2006 | Choi et al. | |
| 2007/0018917 | A1 | 1/2007 | Miyazawa | |
| 2007/0024540 | A1 | 2/2007 | Ryu et al. | |
| 2007/0024541 | A1 | 2/2007 | Ryu et al. | |
| 2007/0024542 | A1 | 2/2007 | Chung et al. | |
| 2007/0024543 | A1 | 2/2007 | Chung et al. | |
| 2007/0024544 | A1 | 2/2007 | Chung et al. | |

(Continued)

FOREIGN PATENT DOCUMENTS

JP 11-219146 8/1999

(Continued)

OTHER PUBLICATIONS

Office Action issued by the Korean Intellectual Property Office on Mar. 23, 2009.

(Continued)

*Primary Examiner* — Muhammad N Edun
(74) *Attorney, Agent, or Firm* — Christie, Parker & Hale, LLP

(57) ABSTRACT

An organic light emitting display includes a plurality of pixels arranged at intersecting points of data lines, scan lines and light emitting control lines; a sensing unit extracting a signal corresponding to a degradation level of organic light emitting diodes provided in each of the pixels; a storage unit storing the signal obtained from the sensing unit, calculating degradation level information of the organic light emitting diodes using the stored signal and storing the calculated information; a conversion unit for converting an input data (Data) into a correction data (Data') using the degradation level information stored in the storage unit; and a data driver for receiving the correction data (Data') outputted from the conversion unit and generating data signals to be supplied to the circuits.

19 Claims, 5 Drawing Sheets

U.S. PATENT DOCUMENTS

| | | | |
|---|---|---|---|
| 2007/0035487 | A1 | 2/2007 | Ryu et al. |
| 2007/0085781 | A1 | 4/2007 | Chung et al. |
| 2008/0001854 | A1 | 1/2008 | Hamer et al. |
| 2008/0036703 | A1 | 2/2008 | Wang et al. |
| 2008/0122759 | A1 | 5/2008 | Levey |
| 2008/0180365 | A1 | 7/2008 | Ozaki |
| 2008/0224962 | A1 | 9/2008 | Kasai et al. |
| 2008/0231562 | A1 | 9/2008 | Kwon |
| 2008/0252568 | A1 | 10/2008 | Kwon |
| 2008/0252569 | A1 | 10/2008 | Kwon |
| 2008/0252570 | A1 | 10/2008 | Kwon |
| 2009/0027376 | A1 | 1/2009 | Kwon |
| 2009/0027377 | A1 | 1/2009 | Kwon |
| 2009/0027423 | A1 | 1/2009 | Kwon |
| 2009/0184901 | A1 | 7/2009 | Kwon |
| 2009/0184903 | A1 | 7/2009 | Kwon |
| 2009/0309818 | A1 | 12/2009 | Kim |
| 2011/0007067 | A1 | 1/2011 | Ryu et al. |

FOREIGN PATENT DOCUMENTS

| | | |
|---|---|---|
| JP | 2002-278514 | 9/2002 |
| JP | 2003-022049 | 1/2003 |
| JP | 2003-058106 | 2/2003 |
| JP | 2003-195813 | 7/2003 |
| JP | 2004-004673 | 1/2004 |
| JP | 2004-101767 | 4/2004 |
| JP | 2004-145257 | 5/2004 |
| JP | 2005-043888 | 2/2005 |
| JP | 2005-115144 | 4/2005 |
| JP | 2005-128272 | 5/2005 |
| JP | 2005-258427 | 9/2005 |
| JP | 2005-308775 | 11/2005 |
| JP | 2005-309230 | 11/2005 |
| JP | 2006-058352 | 3/2006 |
| JP | 2006-126874 | 5/2006 |
| JP | 2007-052202 | 3/2007 |
| JP | 2007-140325 | 6/2007 |
| JP | 2007-206139 | 8/2007 |
| KR | 2001-80746 | 8/2001 |
| KR | 2003-81080 | 10/2003 |
| KR | 2003-0094721 | 12/2003 |
| KR | 10-2004-0092617 | 11/2004 |
| KR | 2005-49320 | 5/2005 |
| KR | 10-2005-0052332 | 6/2005 |
| KR | 10-2006-0029062 | 4/2006 |
| KR | 10-2006-0112995 | 11/2006 |
| KR | 2006-112993 | 11/2006 |
| KR | 10-2006-0132795 | 12/2006 |
| KR | 10-2007-0000422 | 1/2007 |
| KR | 10-2007-0015826 | 2/2007 |
| KR | 10-2007-0019882 | 2/2007 |
| WO | WO 98/40871 | 9/1998 |
| WO | WO 2005/015530 | 2/2005 |
| WO | WO 2005/109389 | 11/2005 |
| WO | WO 2006/063448 A1 | 6/2006 |
| WO | WO 2007/036837 | 4/2007 |
| WO | WO 2007/037269 A1 | 4/2007 |
| WO | WO 2007/090287 | 8/2007 |

OTHER PUBLICATIONS

European Office Action dated May 7, 2010, issued in corresponding European Patent Application No. 09150727.7.

Office Action issue by the Korean Intellectual Property Office on May 28, 2009.

European Search Report dated Apr. 8, 2011, for corresponding European Patent application 09150727.7, listing reference in this IDS, as well as WO 2007/036837, previously submitted in an IDS dated Jul. 26, 2010.

Japanese Office action dated Jan. 4, 2011, for corresponding Japanese Patent application 2008-068098, noting listed reference in this IDS.

Japanese Office action dated Oct. 4, 2011, for Japanese Patent application 2007-306366, 2 pages.

KIPO Notice of Allowance dated Mar. 31, 2009 for Korean Patent application 10-2007-0084730, 2 pages.

Japanese Office action dated Nov. 16, 2010, for Japanese Patent application 2007-306366, 3 pages.

U.S. Office action dated May 24, 2011, for cross-reference U.S. Appl. No. 12/124,250, 39 pages.

European Search Report ated May 11, 2011, for European Patent application 08162287.0, 7 pages.

KIPO Office action dated Aug. 29, 2008 for Korean Patent application 10-2007-0028166, 2 pages.

KIPO Notice of Allowance dated Jun. 26, 2008 for Korean Patent application 10-2007-0035009, 2 pages.

U.S. Office action dated Mar. 3, 2011, for cross-reference U.S. Appl. No. 12/082,147, 18 pages.

KIPO Office action dated Aug. 29, 2008, for Korean Patent application 10-2007-0035011, 2 pages.

KIPO Notice of Allowance dated Jun. 26, 2008, for Korean Patent application 10-2007-0035012, 2 pages.

U.S. Office action dated Aug. 4, 2011, for cross-reference U.S. Appl. No. 12/082,147. 20 pages.

U.S. Office action dated Mar. 8, 2011, for cross-reference U.S. Appl. No. 12/077,828, 9 pages.

U.S. Office action dated Mar. 15, 2011, for cross-reference U.S. Appl. No. 12/080,956, 9 pages.

U.S. Notice of Allowance dated Sep. 28, 2011, for cross-reference U.S. Appl. No. 12/124,250, 18 pages.

Japanese Office action dated Feb. 28, 2012, for Japanese Patent application 2007-306366, (3 pages).

* cited by examiner

ORGANIC LIGHT EMITTING DISPLAY AND DRIVING METHOD THEREOF

CROSS-REFERENCE TO RELATED APPLICATION

This application claims priority to and the benefit of Korean Patent Application No. 2008-5615, filed on Jan. 18, 2008, in the Korean Intellectual Property Office, the content of which is incorporated herein by reference.

BACKGROUND OF THE INVENTION

1. Field of the Invention

An aspect of the present invention relates to an organic light emitting display and a driving method thereof, and more particularly to an organic light emitting display capable of displaying an image having uniform luminance regardless of the degradation of organic light emitting diodes, and a driving method thereof.

2. Description of the Related Art

In recent years, there have been developed a variety of flat panel displays having a reduced weight and volume compared to the cathode ray tube (CRT). The flat panel displays include liquid crystal displays (LCD), field emission displays (FED), plasma display panels (PDP), organic light emitting displays (OLED), etc.

Among the flat panel displays, the organic light emitting display uses an organic light emitting diode to display an image. The organic light emitting diode generates light by recombining electrons and holes. Such an organic light emitting display is advantageous in that it has a rapid response time and is driven by a small amount of power.

FIG. 1 is a circuit diagram showing a pixel of a conventional organic light emitting display. Referring to FIG. 1, the pixel 4 of the conventional organic light emitting display includes an organic light emitting diode (OLED) and a pixel circuit 2 coupled to a data line (Dm) and a scan line (Sn) to control an organic light emitting diode (OLED).

An anode electrode of the organic light emitting diode (OLED) is coupled to the pixel circuit 2, and a cathode electrode is coupled to a second power source (ELVSS). Such an organic light emitting diode (OLED) generates the light having a predetermined luminance using an electric current supplied from the pixel circuit 2. When a scan signal is supplied to the scan line (Sn), the pixel circuit 2 controls the capacity of current supplied to the organic light emitting diode (OLED) to correspond to a data signal supplied to the data line (Dm).

For this purpose, the pixel circuit 2 includes first and second transistors (M1 and M2) and a storage capacitor (Cst). Here, the second transistor (M2) is coupled between a first power source (ELVDD) and the organic light emitting diode (OLED), and the first transistor (M1) is coupled between the second transistor (M2), the data line (Dm) and the scan line (Sn). Also, the storage capacitor (Cst) is coupled between a gate electrode of the second transistor (M2) and a first electrode.

More particularly, the gate electrode of the first transistor (M1) is coupled to the scan line (Sn), and the first electrode is coupled to the data line (Dm). A second electrode of the first transistor (M1) is coupled to one side terminal of the storage capacitor (Cst).

Here, the first electrode is set to one of a source electrode and a drain electrode, and the second electrode is set to the other electrode that is different from the first electrode. For example, if the first electrode is set to a source electrode, the second electrode is set to a drain electrode. The first transistor (M1) coupled to the scan line (Sn) and the data line (Dm) is turned on when a scan signal is supplied from the scan line (Sn), and supplies a data signal, supplied from the data line (Dm), to the storage capacitor (Cst). At this time, the storage capacitor (Cst) is charged with a voltage corresponding to the data signal.

A gate electrode of the second transistor (M2) is coupled to one side terminal of the storage capacitor (Cst), and the first electrode of the second transistor (M2) is coupled to the other side terminal of the storage capacitor (Cst) and to the first power source (ELVDD). The second electrode of the second transistor (M2) is coupled to an anode electrode of the organic light emitting diode (OLED).

Such a second transistor (M2) controls the capacity of current that flows from the first power source (ELVDD) to the second power source (ELVSS) via the organic light emitting diode (OLED) to correspond to the voltage value stored in the storage capacitor (Cst). At this time, the organic light emitting diode (OLED) generates light corresponding to the current capacity supplied from the second transistor (M2).

However, the conventional organic light emitting display is disadvantageous in that it is impossible to display an image having a desired luminance due to the efficiency change caused by the degradation of the organic light emitting diode (OLED).

The organic light emitting diode (OLED) degrades with time, and therefore light with gradually decreasing luminance is generated in response to the same data signal.

SUMMARY OF THE INVENTION

Accordingly, an aspect of the present invention provides an organic light emitting display capable of displaying an image having uniform luminance regardless of the degradation of the organic light emitting diodes by accurately detecting and storing a degradation level of the organic light emitting diodes provided in each of the pixels, converting obtained data from the organic light emitting diodes and providing converted data to compensate for the degradation of the organic light emitting diodes, and a driving method thereof.

One embodiment of the present invention is achieved by providing an organic light emitting display including a plurality of pixels arranged in intersecting points of data lines, scan lines and light emitting control lines; a sensing unit to extract a signal corresponding to a degradation level of organic light emitting diodes provided in each of the pixels; a storage unit to store a signal extracted from the sensing unit, calculating only information on a degradation level of the organic light emitting diodes using the stored signal and storing the calculated information; a conversion unit to convert an input data (Data) into a correction data (Data') using the information on the degradation level stored in the storage unit; and a data driver to receive the correction data (Data') outputted from the conversion unit and generating data signals to be supplied to the circuits.

According to another aspect of the present invention, the sensing unit includes a sensing circuit arranged in each of channels, wherein the sensing circuit includes a first current source unit to supply a first electric current into an organic light emitting diode in the pixel; a second current source unit to supply a second electric current into an organic light emitting diode in the pixel; and first and second switching elements (SW1 and SW2) coupled respectively to the first and second current source units. The second electric current is higher k times (k is an integer) than the first electric current.

According to another aspect of the present invention, the second switching element (SW2) is turned on when the first switching element (SW1) is turned off, that is, the first and second switching elements are sequentially turned on.

According to another aspect of the present invention, the sensing unit further includes at least one analog/digital conversion unit for converting a first voltage into a first digital value, the first voltage being extracted to correspond to the first electric current supplied to the organic light emitting diode, and converting a second voltage into a second digital value, the second voltage being extracted to correspond to the second electric current supplied to the organic light emitting diode.

According to another aspect of the present invention, the storage unit includes a first register to store a first digital value; a second register to store a second digital value; a processing unit extracting only information on a degradation level of an organic light emitting diode in each of pixels using a value stored in the first and second registers; and a third register to store the information on the degradation level of the organic light emitting diode in each of the pixel, the information being extracted from the processing unit. The processing unit multiplies the first digital value stored in the first register by k (k is an integer), and generates the difference between the k-time first digital value and the second digital value stored in the second register.

According to another aspect of the present invention, the conversion unit includes a look-up table (LUT) addressed by a signal outputted from the storage unit to generate a certain corrected value; and a frame memory to store the corrected value generated in the look-up table. The signal outputted from the storage unit is information regarding the degradation level of the organic light emitting diode in each of the pixels, the information being stored in third register of the storage unit.

Another embodiment of the present invention is achieved by providing a method for driving an organic light emitting display, the method including: generating a first voltage while supplying a first electric current to an organic light emitting diode included in each of the pixels; generating a second voltage while supplying a second electric current to an organic light emitting diode included in each of the pixels; converting the first voltage and the second voltage into a first digital value and a second digital value, respectively, and storing the converted first and second digital values; extracting only information on a degradation level of the organic light emitting diode in each of the pixels using the stored first and the second digital value; converting an input data (Data) into a correction data (Data') so as to display an image having uniform luminance regardless of the degradation level of the organic light emitting diode, by using the extracted information on the degradation level of the organic light emitting diode in each of the pixels; and supplying a data signal to data lines, the data line corresponding to the correction data (Data').

According to another aspect of the present invention, the first voltage and the second voltage are generated during a non-display period prior to displaying an image after a power source is applied to the organic light emitting display.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
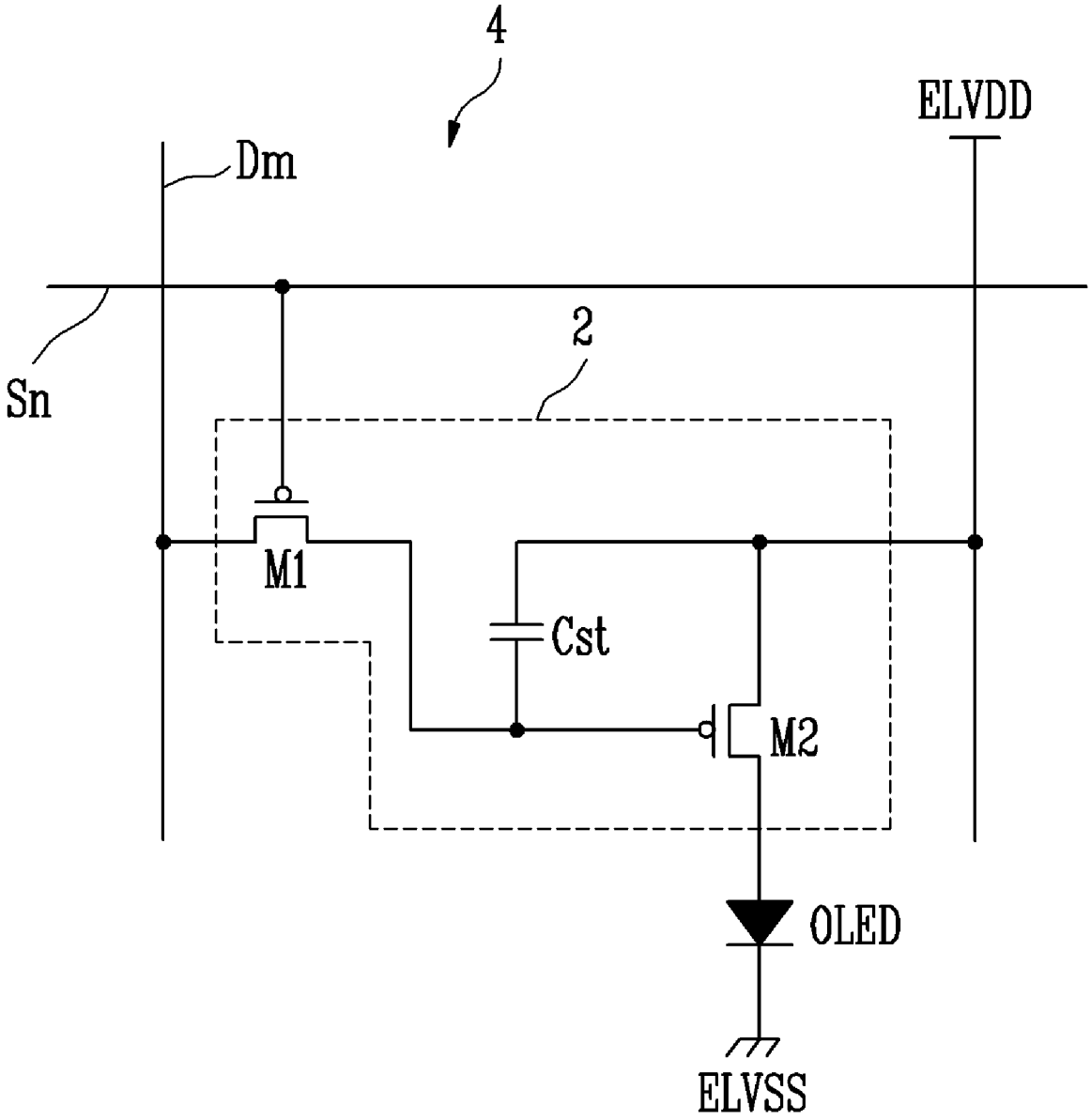
FIG. 1 (PRIOR ART)
FIG. 1 is a circuit diagram showing a conventional pixel.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Figure 2:
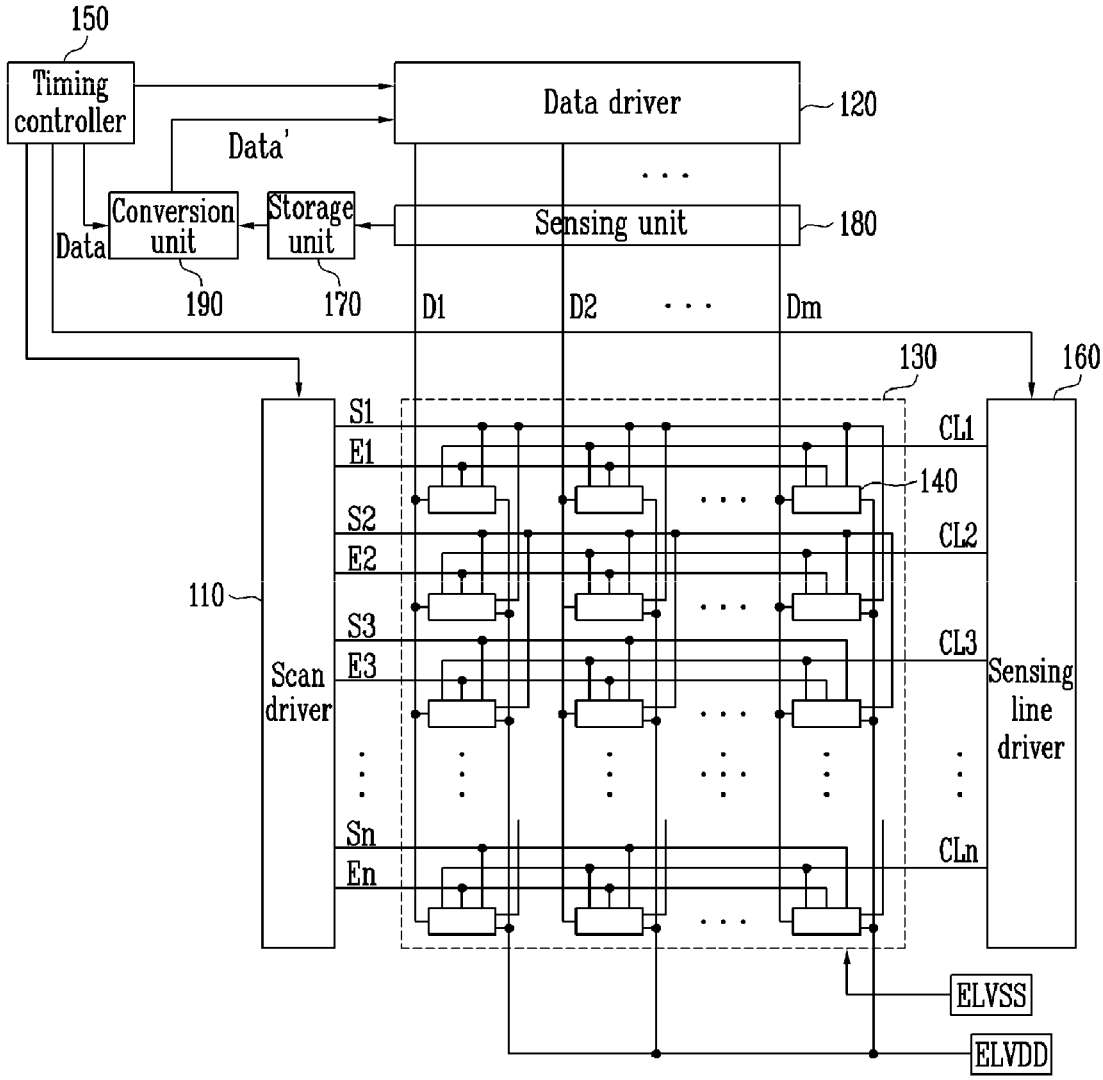
FIG. 2 is a block diagram showing an organic light emitting display according to one exemplary embodiment of the present invention.

FIG. 2 is a diagram showing an organic light emitting display according to one exemplary embodiment of the present invention. Referring to FIG. 2, the organic light emitting display according to one exemplary embodiment of the present invention includes a pixel unit 130, a scan driver 110, a sense line driver 160, a data driver 120, and a timing controller 150. Also, the organic light emitting display according to one exemplary embodiment of the present invention further includes a sensing unit 180, a storage unit 170, and a conversion unit 190.

In the present exemplary embodiment of the present invention, reference electric currents having different levels are supplied to an organic light emitting diode in each of the pixels 140 so as to accurately detect a degradation level of the organic light emitting diode in each of the pixels 140 included in the pixel unit 130. Then, a voltage of each of the organic light emitting diode is measured, the voltage being generated by the supply of the electric current. Next, an accurate degradation level of the organic light emitting diodes is calculated using the information on each of the measured voltages. Therefore, this exemplary embodiment is characterized in that the degradation level of the organic light emitting diodes is prevented from being distorted by a voltage drop (IR DROP) that is caused by the resistance of lines through which the information on the degradation level is obtained and supplied, the internal resistance of switching elements arranged on the lines, etc.

The pixel unit 130 includes pixels 140 arranged on intersecting points of scan lines (S1 to Sn), light emitting control lines (E1 to En), sense lines (CL1 to CLn), and data lines (D1 to Dm). The pixels 140 receive power from a first power source (ELVDD) and a second power source (ELVSS) from the outside. The pixels 140 control current capacity to correspond to a data signal, the current capacity being supplied from the first power source (ELVDD) to the second power source (ELVSS) via the organic light emitting diodes. A light having a predetermined luminance is generated in the organic light emitting diodes.

The scan driver 110 supplies a scan signal to the scan lines (S1 to Sn) under the control of the timing controller 150. Also, the scan driver 110 supplies a light emitting control signal to the light emitting control lines (E1 to En) under the control of the timing controller 150. Therefore, the scan driver 110 drives the scan lines (S1 to Sn) and the light emitting control lines (E1 to En).

The sense line driver 160 drives the sense lines (CL1 to CLn) by supplying a sense signal to the sense lines (CL1 to CLn) under the control of the timing controller 150.

The data driver 120 drives the data lines (D1 to Dm) by supplying a data signal to the data lines (D1 to Dm) under the control of the timing controller 150.

The sensing unit 180 obtains degradation level information of the organic light emitting diode included in each of the pixels 140. To do so, the sensing unit 180 supplies different levels of reference electric currents to the organic light emitting diodes so as to accurately obtain the degradation level of the organic light emitting diode in each of the pixels 140. Such a sensing unit 180 obtains a degradation level of the organic light emitting diode by measuring a voltage of each of the organic light emitting diodes, the voltage being generated by the supply of the electric current.

Here, the degradation information of the organic light emitting diodes is preferably carried out for a non-display period prior to displaying an image after a power source is applied to the organic light emitting display. That is, the degradation information of the organic light emitting diodes may be obtained whenever the power source is applied to the organic light emitting display.

The storage unit 170 stores a signal output by the sensing unit 180, calculates an exact degradation level of the organic light emitting diode using the stored signal, and stores the calculated degradation level.

That is, the storage unit 170 calculates the degradation level of the organic light emitting diode using the information on each of the voltages output by the sensing unit 180. Therefore, the storage unit 170 prevents the organic light emitting diodes from being distorted by a voltage drop (IR DROP) that is caused by the resistance of lines through which the information on the degradation level is extracted and supplied, the internal resistance of switching elements arranged on the lines, etc.

The conversion unit 190 converts an input data (Data) from the timing controller 150 into a correction data (Data') so as to display an image with uniform luminance regardless of the degradation level of the organic light emitting diodes, by using the degradation level information stored in the storage unit 170.

That is, data (Data), which is inputted from the outside and outputted from the timing controller 150, is converted into a correction data (Data') by the conversion unit 190 so as to compensate for the degradation of the organic light emitting diodes, and then supplied to the data driver 120. Then, the data driver 120 generates a data signal using the converted correction data (Data'), and supplies the generated data signal to the pixels 140.

The timing controller 150 controls the data driver 120, the scan driver 110, and the sense line driver 160.

Figure 3:
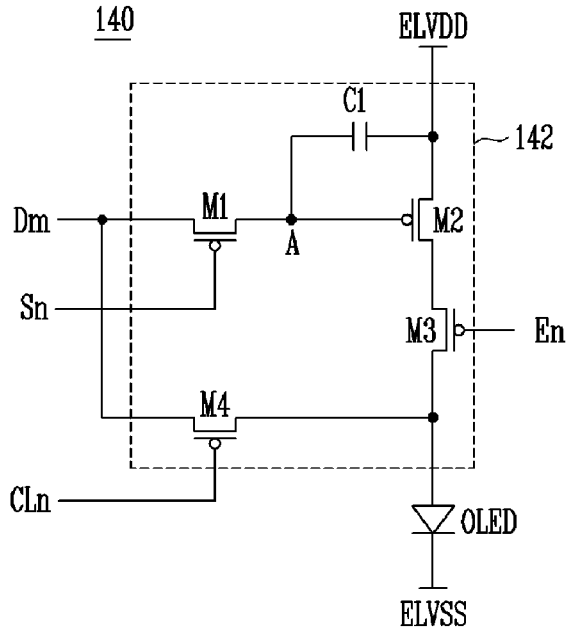
FIG. 3 is a circuit diagram showing one exemplary embodiment of the pixel as shown in FIG. 2.

FIG. 3 shows one exemplary embodiment of the pixel shown in FIG. 2. For convenience of the description, it is shown that a pixel is coupled to an $m^{th}$ data line (Dm) and an $n^{th}$ scan line (Sn).

Referring to FIG. 3, the pixel 140 according to one exemplary embodiment of the present invention includes an organic light emitting diode (OLED) and a pixel circuit 142 for supplying an electric current to the organic light emitting diode (OLED).

An anode electrode of the light emitting diode (OLED) is coupled to the pixel circuit 142, and a cathode electrode is coupled to the second power source (ELVSS). Such an organic light emitting diode (OLED) generates the light having a predetermined luminance to correspond to an electric current supplied from the pixel circuit 142.

The pixel circuit 142 receives a data signal supplied to the data line (Dm) when a scan signal is supplied to the scan line (Sn). Also, the pixel circuit 142 supplies the information about the degradation of the organic light emitting diode (OLED) to the sensing unit 180 when a sense signal is supplied to the sense line (CLn). For this purpose, the pixel circuit 142 includes 4 transistors (M1 to M4) and one first capacitor (C1).

A gate electrode of the first transistor (M1) is coupled to the scan line (Sn), and a first electrode of the first transistor (M1) is coupled to the data line (Dm), and a second electrode of the first transistor (M1) is coupled to a first node (A).

A gate electrode of the second transistor (M2) is coupled to the first node (A), and a first electrode of the second transistor (M2) is coupled to the first power source (ELVDD).

Also, a first capacitor (C1) is coupled between the first power source (ELVDD) and the first node (A).

The second transistor (M2) controls the current capacity corresponding to the voltage value stored in the first capacitor (C1), and the current flowing from the first power source (ELVDD) to the second power source (ELVSS) via the organic light emitting diode (OLED). The organic light emitting diode (OLED) generates light corresponding to the current capacity supplied from the second transistor (M2).

A gate electrode of the third transistor (M3) is coupled to the light emitting control line (En), and a first electrode of the third transistor (M3) is coupled to the second electrode of the second transistor (M2). A second electrode of the third transistor (M3) is coupled to the organic light emitting diode (OLED). The third transistor (M3) is turned off when a light emitting control signal is supplied to the light emitting control line (En) (at a high level), and turned on when a light emitting control signal is supplied to the light emitting control line (En) (at a low level). Here, the light emitting control signal is supplied to the first capacitor (C1) for a period (a programming period) for charging a voltage corresponding to the data signal and a period (an OLED degradation sensing period) for sensing information about the degradation of the organic light emitting diode (OLED).

A gate electrode of the fourth transistor (M4) is coupled to the sense line (CLn), and a first electrode of the fourth transistor (M4) is coupled to an anode electrode of the organic light emitting diode (OLED). Also, a second electrode of the fourth transistor (M4) is coupled to the data line (Dm). The fourth transistor (M4) is turned on when a sense signal is supplied to the sense line (CLn), and turned off in the other cases. Here, the sense signal is supplied for a period (an OLED degradation sensing period) for sensing information on the degradation of the organic light emitting diode (OLED).

However, when the information on the degradation of the organic light emitting diode (OLED) is sensed, the sensed signal is supplied to the sensing unit 180 via the fourth transistor (M4) and the data line (Dm). Therefore, the information about the degradation of the organic light emitting diode (OLED) may be distorted by a voltage drop (IR DROP) that is caused by an inherent resistance of the data line (Dm) and an internal resistance of the fourth transistor (M4), etc.

In the present exemplary embodiment of the present invention, reference electric currents having different levels are supplied to the organic light emitting diode (OLED) in each of the pixels 140 so as to obtain a degradation level of the organic light emitting diode (OLED) in each of the pixels 140 included in the pixel unit 130. Then, a voltage of each of the organic light emitting diode is measured, the voltage being generated by the supply of the electric current. Next, a degradation level of the organic light emitting diodes (OLED) is calculated using the information on each of the measured voltages. Therefore, an aspect of the present invention is characterized in that the information about the degradation level of the organic light emitting diodes is prevented from being distorted by a voltage drop (IR DROP) that is caused by the resistance of lines through which the information on the degradation level is obtained and supplied, the internal resistance of switching elements arranged on the lines, etc.

Hereinafter, a sensing unit, a storage unit, and a conversion unit provided in this exemplary embodiment of the present invention will be described in more detail.

Figure 4:
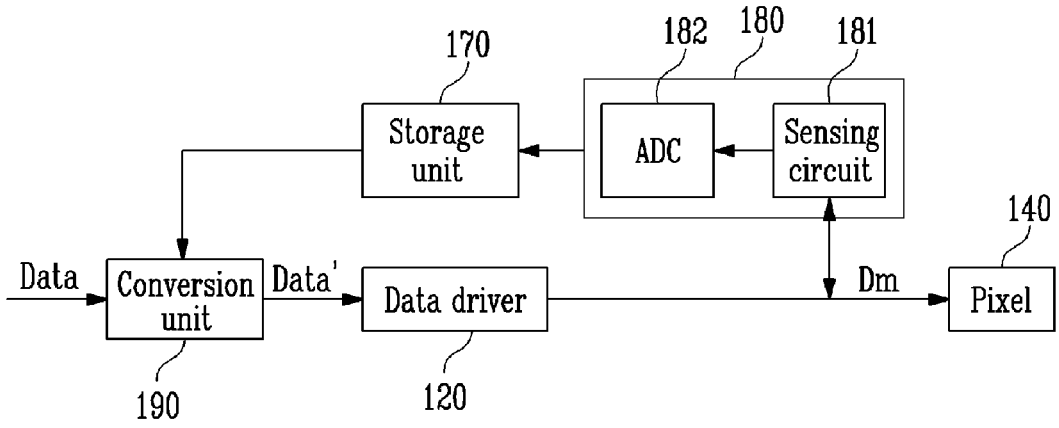
FIG. 4 is a diagram schematically showing a sensing unit, a storage unit, a conversion unit, and a data driver as shown in FIG. 2.

FIG. 4 is a diagram schematically showing a sensing unit 180, a storage unit 170, and a conversion unit 190 as shown in FIG. 2. FIG. 4 also shows that a pixel is coupled to an $m^{th}$ data line (Dm).

Referring to FIG. 4, a sensing circuit 181 and an analog/digital conversion unit (hereinafter, referred to as "ADC") 182 are provided in each of the channels of the sensing unit 180 (Here, one ADC may be shared with a plurality of channels or all channels).

At this time, the sensing unit 180 obtains degradation level information of the organic light emitting diode included in each of the pixels 140. For this purpose, the sensing unit 180 supplies different levels of reference electric currents to organic light emitting diodes so as to exactly extract the degradation level of the organic light emitting diode in each of the pixels 140. Such a sensing unit 180 obtains the degradation level information of the organic light emitting diodes by measuring a voltage of each of the organic light emitting diodes, the voltage being generated by the supply of the electric current.

Also, the information obtained from the sensing unit 180 is supplied to the storage unit 170. The storage unit 170 stores a signal output by the sensing unit 180, calculates a degradation level of the organic light emitting diodes using the stored signal, and stores the calculated degradation level.

The storage unit 170 calculates the degradation level information of the organic light emitting diodes using the information of each of the voltages obtained from the sensing unit 180. Therefore, the storage unit 170 prevents the degradation level information of the organic light emitting diodes from being distorted by a voltage drop (IR DROP) that is caused by the resistance of lines through which the degradation level information is obtained and supplied, the internal resistance of switching elements arranged on the lines, etc.

Also, the conversion unit 190 converts an input data (Data) from the timing controller 150 into a correction data (Data') so as to display an image with uniform luminance regardless of the degradation level of the organic light emitting diodes, by using the degradation level information stored in the storage unit 170. The correction data (Data') is supplied to the data driver 120, and finally to each of the pixels 140 in the panel.

Figure 5:
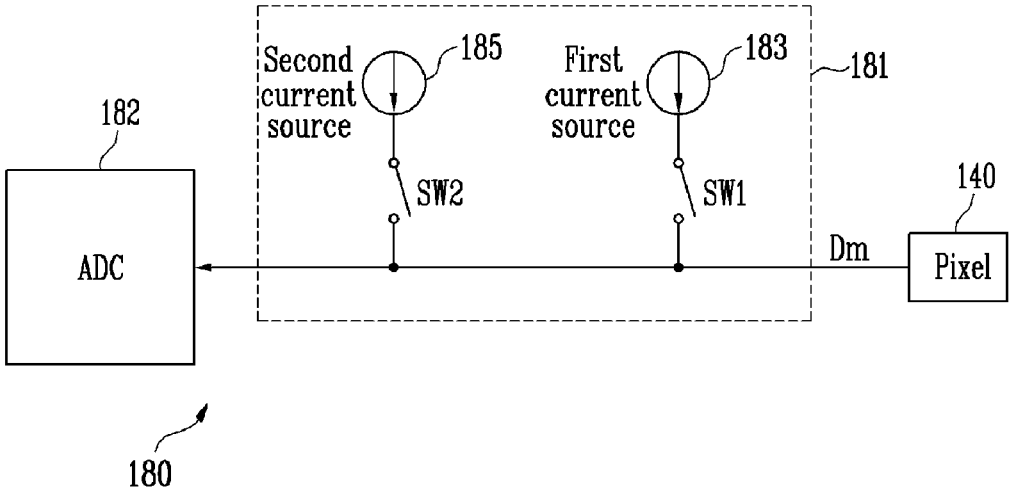
FIG. 5 is a diagram schematically showing a sensing circuit of the sensing unit as shown in FIG. 4.

FIG. 5 is a diagram schematically showing a sensing circuit of the sensing unit as shown in FIG. 4. Referring to FIG. 5, the sensing circuit 181 includes first and second current source units 183 and 185 and switching elements (SW1 and SW2) coupled respectively to the first and second current source units 183 and 185.

The first current source unit 183 supplies a first electric current ($I_{ref}$) to the pixels 140 when a first switching element (SW1) is turned on. That is, the first electric current is supplied to the organic light emitting diodes (OLED) included in the pixels 140, and a predetermined voltage generated in the organic light emitting diode of each of the pixels 140 is supplied to the ADC 182 when the first electric current is supplied to the pixels 140. At this time, the predetermined voltage (or, a first voltage) generated by the first current source unit 183 has the degradation level information of the organic light emitting diodes (OLED).

An internal resistance value of the organic light emitting diode (OLED) is changed according to the degradation of the organic light emitting diode (OLED). That is, a voltage value is changed, the voltage value being generated by the electric current that is applied to correspond to the degradation of the organic light emitting diode. Therefore, it is possible to obtain the degradation information of the organic light emitting diode (OLED) using the changed voltage value.

However, the first voltage ($V_{S1}$) does not include only an anode voltage value ($V_{OLED,anode1}$) of the organic light emitting diodes because of the application of the first electric current, but also includes a voltage value ($\Delta V_{Dm}$) dropped by the data line (Dm); and a voltage value ($\Delta V_{M4}$) dropped by the fourth transistor (M4), as described above. That is, the first voltage ($V_{S1}$) becomes $V_{S1}=V_{OLED,anode1}+\Delta V_{Dm}+\Delta V_{M4}$.

This indicates that the first voltage ($V_{S1}$) includes only the degradation information of the organic light emitting diodes (OLED).

According to the present exemplary embodiment of the present invention, a second current source unit 185 for supplying a second electric current ($2I_{ref}$) is further provided to obtain exact degradation information of the organic light emitting diode.

That is, the second current source unit 185 supplies a second electric current ($2I_{ref}$) to the pixels 140 when a second switching element (SW2) is turned on, and supplies a predetermined voltage, generated in the organic light emitting diode in each of the pixels 140, to the ADC 182 when the second electric current is supplied to the pixels 140. The second electric current is supplied via the organic light emitting diodes (OLED) included in the pixels 140. Therefore, the predetermined voltage (or, a second voltage) generated in the second current source unit 185 has the degradation information of the organic light emitting diodes (OLED).

In the present exemplary embodiment of the present invention, the second electric current is twice as high as the first electric current, which is merely one exemplary embodiment. Therefore, the present invention is not particularly limited thereto.

Also, the second switching element (SW2) is turned on when the first switching element (SW1) is turned off, i.e., it is preferable that the first and second switching elements (SW1 and SW2) are not turned on at the same time but are rather sequentially turned on.

As described above, the degradation information of the organic light emitting diodes is preferably obtained during a non-display period prior to displaying an image after a power source is applied to the organic light emitting display. That is, the first and second switching elements (SW1 and SW2) are sequentially turned on during the non-display period.

In this case, the second voltage ($V_{S2}$) includes not only an anode voltage value ($V_{OLED,anode2}$) of the organic light emitting diodes by the application of the second electric current, but also includes a voltage value ($\Delta V_{Dm}'$) drop of the data line (Dm); and a voltage value ($\Delta V_{M4}'$) drop of the fourth transistor (M4), as described above. That is, the second voltage ($V_{S2}$) becomes $V_{S2}=V_{OLED,anode2}+\Delta V_{Dm}'+\Delta V_{M4}'$.

However, for the exemplary embodiment, $\Delta V_{Dm}'\approx 2\Delta V_{Dm}$, and $\Delta V_{M4}'\approx 2\Delta V_{M4}$ since the second electric current ($2I_{ref}$) is twice as high as the first electric current ($I_{ref}$).

As described above, two current source units 183 and 185 are provided to supply different levels of electric currents, therefore the degradation level information of the orgain light emitting diode in each of the pixels 140 is obtained from each of the voltage values corresponding to the supplied electric currents. This prevents the degradation level information of the organic light emitting diodes from being distorted by a voltage drop (IR DROP) that is caused by the resistance of a data line (Dm) through which the information on the degradation level is extracted and supplied, the internal resistance of a fourth transistor (M4) arranged on the data line (Dm), etc.

Also, each of the extracted first voltage ($V_{S1}$) and second voltage ($V_{S2}$) is converted into respective digital values corresponding to the extracted first voltage ($V_{S1}$) and the second voltage ($V_{S2}$) by the ADC 182. That is, the first voltage ($V_{S1}$) is converted into the first digital value, and the second voltage ($V_{S2}$) is converted into the second digital value.

Figure 6:
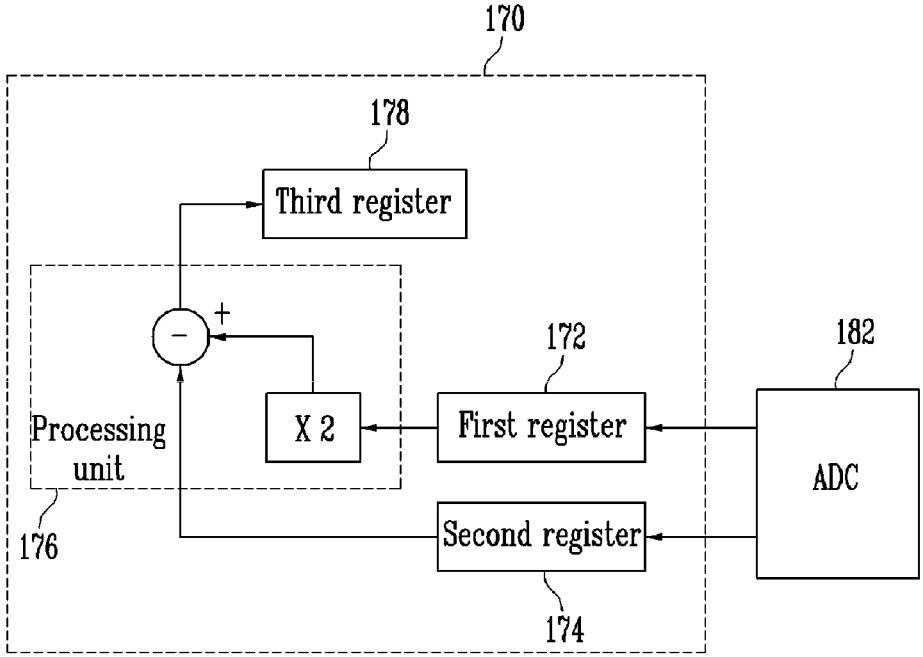
FIG. 6 is a diagram schematically showing an internal configuration of the storage unit as shown in FIG. 4.

FIG. 6 is a diagram schematically showing an internal configuration of the storage unit shown in FIG. 4.

As described above, the storage unit 170 calculates an exact degradation level of the organic light emitting diode using the information of each of the voltages obtained from the sensing unit 180. Therefore, the storage unit 170 prevents the degradation level of the organic light emitting diodes from being distorted by a voltage drop (IR DROP) that is caused by the resistance of a data line (Dm) through which the information on the degradation level is extracted and supplied, the internal resistance of a fourth transistor (M4) arranged on the data line (Dm), etc.

More particularly referring to FIG. 6, the storage unit 170 includes a first register 172, a second register 174, a processing unit 176, and a third register 178.

A digital value into which a first voltage ($V_{S1}$) is converted by the ADC 182 is stored in the first register 172, the first voltage ($V_{S1}$) being generated according to the supply of the first electric current ($I_{ref}$) of the first current source unit 183. A digital value into which a second voltage ($V_{S2}$) is converted by the ADC 182 is stored in the second register 174, the second voltage ($V_{S2}$) being generated according to the supply of the second electric current ($2I_{ref}$) of the second current source unit 185. Also, the processing unit 176 s obtains accurate degradation level information of the organic light emitting diode in each of the pixels using a value stored in the first and second register. The degradation level information of the organic light emitting diode in each of the pixels obtained from the processing unit is stored in the third register 178.

Therefore, a digital value of the first voltage ($V_{S1}$), e.g., $V_{OLED,anode1}+\Delta V_{Dm}+\Delta V_{M4}$ is stored in the first register 172, and a second voltage ($V_{S2}$), e.g., $V_{OLED,anode2}+\Delta V_{Dm}'+\Delta V_{M4}'$ is stored in the second register 174.

For this exemplary embodiment of the present invention, $\Delta V_{Dm}'\approx 2\Delta V_{Dm}$, and $\Delta V_{M4}'\approx 2\Delta V_{M4}$ since the second electric current ($2I_{ref}$) is twice as high as the first electric current ($I_{ref}$).

As a result, the processing unit 176 doubles the first digital value stored in the first register 172, as shown in FIG. 6, by using the information on the degradation level, generates the difference between the doubled first digital value and the second digital value stored in the second register, and stores the generated difference in the third register 178.

The value stored in the third register 178 becomes the degradation level information of the organic light emitting diodes whose effects by voltage drop (IR DROP) are removed, the voltage drop (IR DROP) being generated by the resistance of the data line (Dm) and the internal resistance of the fourth transistor (M4).

Therefore, an operation in the processing unit 176 is represented by the following equations.

$$2*V_{S1}-V_{S2}=$$

$$2\,(V_{OLED,anode1}+\Delta V_{Dm}+\Delta V_{M4})-(V_{OLED,anode2}+\Delta V_{Dm}'+\Delta V_{M4})=$$

$$(2V_{OLED,anode1}-V_{OLED,anode2})+(2\Delta V_{Dm}-\Delta V_{Dm}')+(2\Delta V_{M4}-\Delta V_{M4}')\approx$$

$$2V_{OLED,anode1}-V_{OLED,anode2}$$

According to the equations, effects by the voltage drop (IR DROP) are almost removed by the operation of the processing unit 176, the voltage drop (IR DROP) being generated by the resistance of the data line (Dm) and the internal resistance of the fourth transistor (M4). Eventually, the digital value outputted from the processing unit 176 and stored in the third register 178 becomes the degradation level information of the organic light emitting diodes.

Figure 7:
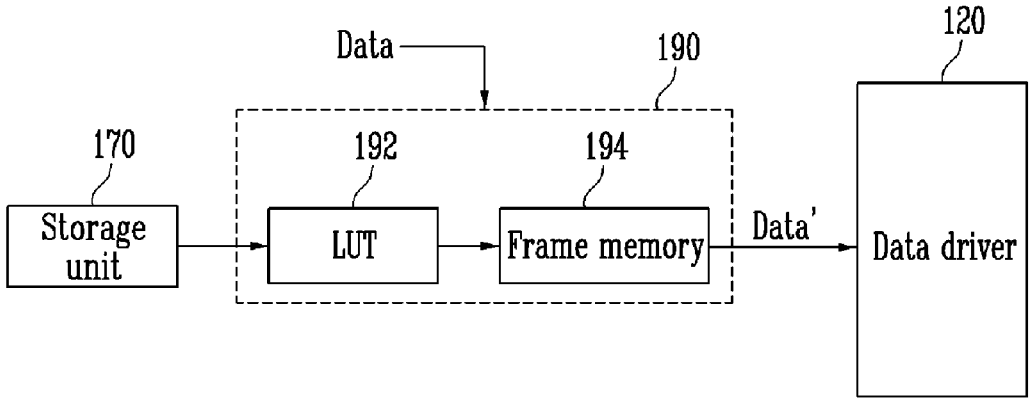
FIG. 7 is a diagram schematically showing an internal configuration of the conversion unit as shown in FIG. 4.

FIG. 7 is a diagram schematically showing an internal configuration of the conversion unit shown in FIG. 4.

The conversion unit 190 converts an input data (Data)from the timing controller into a correction data (Data') so as to display an image with uniform luminance regardless of the degradation level of the organic light emitting diodes, by using the degradation level information stored in the third register 178 of the storage unit 170. Then, the correction data (Data') converted in the conversion unit 190 is supplied to the data driver 120, and finally supplied to each of the pixels 140 in the panel.

More particularly referring to FIG. 7, the conversion unit 190 includes a look-up table (LUT) 192 and a frame memory 194. Here, the look-up table (LUT) 192 is addressed by a signal outputted from the storage unit 170 to generate a certain corrected value. The corrected value generated in the look-up table 192 is stored in the frame memory 194.

The conversion unit 190 receives the degradation level information stored in the third register 178 of the storage unit 170, and converts an input data (Data) into a correction data (Data') through the look-up table 192 and the frame memory 194 so as to display an image with uniform luminance regardless of the degradation level of the organic light emitting diodes provided in each of the pixels. Then, the correction data (Data') converted in the conversion unit 190 is supplied to the data driver 120, and finally supplied to the data driver 120.

Figure 8:
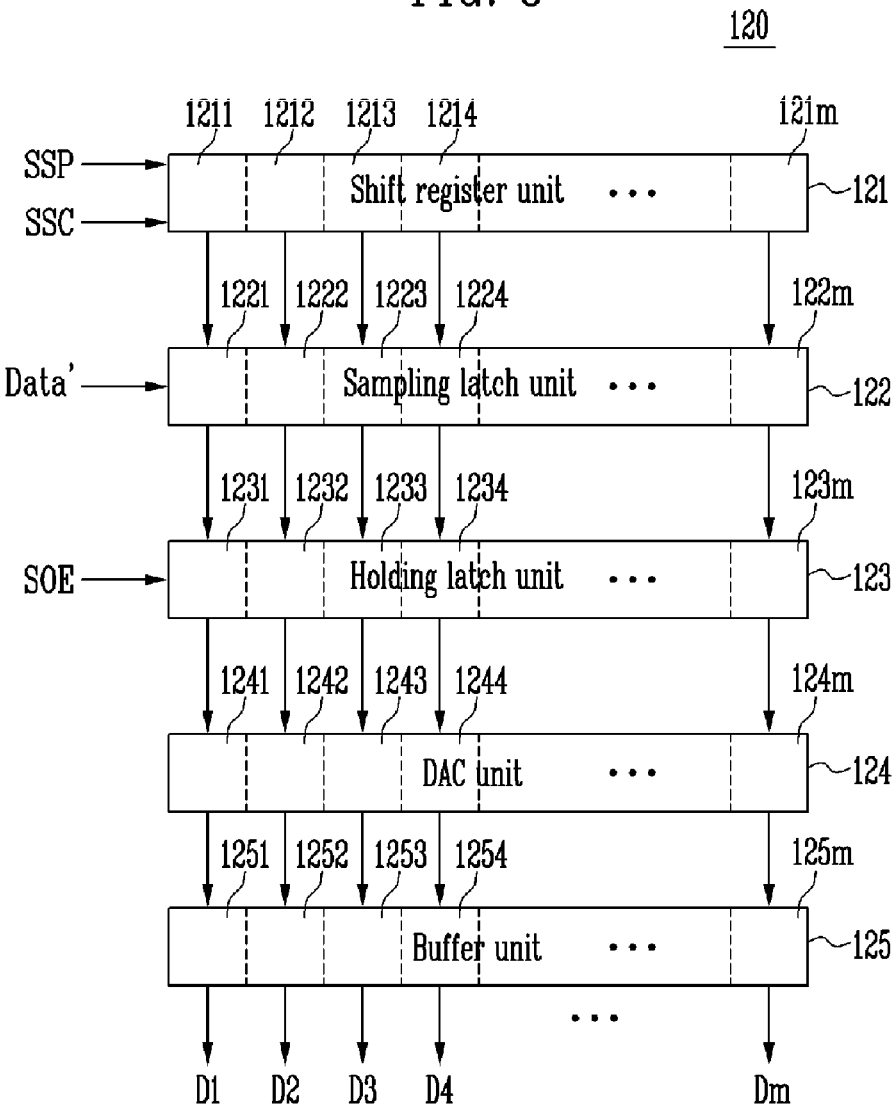
FIG. 8 is a block diagram showing one exemplary embodiment of the data driver as shown in FIG. 4.

FIG. 8 is a block diagram showing one exemplary embodiment of the data driver as shown in FIG. 4.

Referring to FIG. 8, the data driver 120 includes a shift register unit 121, a sampling latch unit 122, a holding latch unit 123, a DAC unit 124, and a buffer unit 125.

The shift register unit 121 receives a source start pulse (SSP) and a source shift clock (SSC) from the timing controller 150. The shift register unit 121 receiving the source shift clock (SSC) and the source start pulse (SSP) sequentially generates an m-numbered sampling signal while shifting a source start pulse (SSP) in every one cycle of the source shift clock (SSC). For this purpose, the shift register unit 121 includes m-numbered shift registers (1211 to 121*m*).

The sampling latch unit 122 sequentially stores the correction data (Data') in response to the sampling signal sequentially supplied from the shift register unit 121. For this purpose, the sampling latch unit 122 includes m-numbered sampling latches 1221 to 122*m* so as to store m-numbered correction data (Data').

The holding latch unit 123 receives a source output enable (SOE) signal from the timing controller 150. The holding latch unit 123 receiving the source output enable (SOE) signal receives the stored correction data (Data') from the sampling latch unit 122. The holding latch unit 123 supplies the correction data (Data') to the DAC unit 124. For this purpose, the holding latch unit 123 includes m-numbered holding latches 1231 to 123*m*.

The DAC unit 124 receives correction data (Data') from the holding latch unit 123, and generates m-numbered data signals to correspond to the received correction data (Data'). The DAC unit 124 includes m-numbered digital/analog converters (DAC) 1241 to 124*m*. That is, the DAC unit 124 generates m-numbered data signals using the DACs 1241 to 124*m* arranged in every channel, and supplies the generated data signals into the buffer unit 125.

The buffer unit 125 supplies the m-numbered data signals supplied from the DAC unit 124 into each of the m-numbered data lines (D1 to Dm). The buffer unit 125 includes m-numbered buffers 1251 to 125*m*.

According to the exemplary embodiment of the present invention, the organic light emitting display has an advantage that it is possible to display an image having uniform luminance regardless of the degradation of the organic light emitting diodes.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display comprising:

a plurality of pixels arranged at intersecting points of data lines, scan lines, and light emitting control lines;

a sensing unit to extract a signal corresponding to a degradation level of organic light emitting diodes provided in each of the pixels;

a storage unit to store the signal obtained by the sensing unit, calculating degradation level information of the organic light emitting diodes using the stored signal, and storing the degradation level information;

a conversion unit to convert an input data into a correction data using the degradation level information stored in the storage unit; and a data driver to receive the correction data outputted from the conversion unit and to generate data signals to be supplied to the plurality of pixels, wherein the sensing unit includes a sensing circuit, wherein the sensing circuit comprises:

a first current source unit to supply a first electric current into the organic light emitting diode provided in each of the pixels;

a second current source unit to supply a second electric current into the organic light emitting diode provided in each of the pixels; and first and second switching elements coupled respectively to the first and second current source units.

2. The organic light emitting display according to claim 1, wherein the second electric current is k times (k is an integer) higher than the first electric current.

3. The organic light emitting display according to claim 1, wherein the second switching element is turned on when the first switching element is turned off.

4. The organic light emitting display according to claim 1, wherein the first and second switching elements are sequentially turned on.

5. The organic light emitting display according to claim 1, wherein the sensing unit further comprises at least one analog/digital conversion unit to convert a first voltage into a first digital value, the first voltage corresponding to the first electric current supplied to the organic light emitting diodes, and to convert a second voltage into a second digital value, the second voltage corresponding to the second electric current supplied to the organic light emitting diodes.

6. The organic light emitting display according to claim 5, wherein the storage unit comprises:

a first register to store the first digital value;

a second register to store the second digital value;

a processing unit to extract degradation level information of the organic light emitting diode in each of the pixels using values respectively stored in the first and second registers; and a third register to store the degradation level information of the organic light emitting diode in each of the pixels, the degradation level information being obtained from the processing unit.

7. The organic light emitting display according to claim 6, wherein the processing unit multiplies the first digital value stored in the first register by k (k is an integer), and generates a difference between the multiplication of the k and the first digital value and the second digital value stored in the second register.

8. The organic light emitting display according to claim 6, wherein the conversion unit comprises:

a look-up table addressed by the signal outputted from the storage unit to generate a corrected value; and a frame memory storing the corrected value generated in the look-up table.

9. The organic light emitting display according to claim 8, wherein the signal outputted from the storage unit comprises the degradation level information of the organic light emitting diode in each of the pixels, the degradation level information being stored in the third register of the storage unit.

10. A method of driving an organic light emitting display, the method comprising:

generating a first voltage at an organic light emitting diode included in each of pixels while supplying a first electric current to the organic light emitting diode;

generating a second voltage at the organic light emitting diode while supplying a second electric current to the organic light emitting diode;

converting the first voltage and the second voltage into a first digital value and a second digital value, respectively, and storing the first and second digital values;

extracting degradation level information of the organic light emitting diode in each of the pixels using the stored first and the second digital values;

converting an input data into a correction data so as to display an image having uniform luminance regardless of the degradation level of the organic light emitting diode, by using the degradation level information of the organic light emitting diode in each of the pixels; and supplying the correction data to data lines.

11. The method for driving the organic light emitting display according to claim 10, wherein the first voltage and the second voltage are generated during a non-display period prior to displaying an image and after a power source is applied to the organic light emitting display.

12. The method for driving the organic light emitting display according to claim 10, wherein the second electric current is k times higher (k is an integer) than the first electric current.

13. An organic light emitting display comprising:

a plurality of pixels arranged at intersecting points of data lines, scan lines, and light emitting control lines, each pixel generating a reference electric current and supplying the reference electric current to organic light emitting diodes provided in the pixels;

a sensing unit obtaining first degradation level information of the organic light emitting diodes by measuring a voltage of each organic light emitting diode generated by the reference electric current;

a storage unit storing the first degradation level information, calculating a second degradation level of the organic light emitting diodes, and storing the second degradation level information;

a conversion unit converting input data into correction data using the second degradation level information stored in the storage unit; and a data driver receiving the correction data outputted from the conversion unit and generating data signals to be supplied to the plurality of pixels.

14. The organic light emitting display according to claim 13, wherein each of the pixels includes one organic light emitting diode and a pixel circuit to supply the reference electric current to the organic light emitting diode.

15. The organic light emitting display according to claim 13, wherein the sensing unit includes a sensing circuit, wherein the sensing circuit comprises:

a first current source unit to supply a first electric current into the organic light emitting diode provided in each of the pixels;

a second current source unit to supply a second electric current into the organic light emitting diode provided in each of the pixels; and first and second switching elements coupled respectively to the first and second current source units.

16. The organic light emitting display according to claim 15, wherein the second electric current is k times (k is an integer) higher than the first electric current.

17. The organic light emitting display according to claim 15, wherein the second switching element is turned on when the first switching element is turned off.

18. The organic light emitting display according to claim 15, wherein the first and second switching elements are sequentially turned on.

19. The organic light emitting display according to claim 15, wherein the sensing unit further comprises at least one analog/digital conversion unit to convert a first voltage into a first digital value, the first voltage corresponding to the first electric current supplied to the organic light emitting diode, and to convert a second voltage into a second digital value, the second voltage corresponding to the second electric current supplied to the organic light emitting diode.

* * * * *